US006978809B2

(12) United States Patent
Quigley

(10) Patent No.: US 6,978,809 B2
(45) Date of Patent: Dec. 27, 2005

(54) COMPOSITE PAPERMAKING FABRIC

(75) Inventor: Scott D. Quigley, Townville, SC (US)

(73) Assignee: Voith Fabrics, Shreveport, LA (US)

( * ) Notice: Subject to any disclaimer, the term of this patent is extended or adjusted under 35 U.S.C. 154(b) by 216 days.

(21) Appl. No.: 10/673,793

(22) Filed: Sep. 29, 2003

(65) Prior Publication Data

US 2005/0067040 A1 Mar. 31, 2005

(51) Int. Cl.[7] ..... D03D 23/00

(52) U.S. Cl. ..... 139/383 A; 139/383 R; 139/408; 139/410; 162/903; 442/203

(58) Field of Search ..... 139/383 A, 383 R, 139/384 R, 408, 410; 162/900; 442/203, 442/205, 207

(56) References Cited

U.S. PATENT DOCUMENTS

| | | | | |
|---|---|---|---|---|
| 2,180,054 | A | 11/1939 | Hindle et al. | |
| 2,934,097 | A | 4/1960 | Hindle et al. | |
| 4,592,396 | A | 6/1986 | Borel | |
| 4,815,499 | A | 3/1989 | Johnson | |
| 4,821,780 | A | 4/1989 | Tate | |
| 4,832,090 | A | 5/1989 | Krenkel | |
| 4,867,206 | A | 9/1989 | Kufferath | |
| 4,909,284 | A | 3/1990 | Kositzke | |
| 5,022,441 | A | 6/1991 | Tate | |
| 5,152,326 | A | 10/1992 | Vohringer | |
| 5,437,315 | A | 8/1995 | Ward | |
| 5,454,405 | A | 10/1995 | Hawes | |
| 5,458,693 | A | 10/1995 | Codorniu | |
| 5,518,042 | A | 5/1996 | Wilson | |
| 5,544,678 | A | 8/1996 | Barrett | |
| 5,713,397 | A | 2/1998 | Quigley | |
| 5,826,627 | A * | 10/1998 | Seabrook et al. | 139/383 A |
| 5,881,764 | A | 3/1999 | Ward | |
| 5,967,195 | A | 10/1999 | Ward | |
| 6,145,550 | A | 11/2000 | Ward | |
| 6,179,013 | B1 | 1/2001 | Gulya | |
| 6,202,705 | B1 | 3/2001 | Johnson | |
| 6,240,973 | B1 | 6/2001 | Stone | |
| 6,244,306 | B1 | 6/2001 | Troughton | |
| 6,334,467 | B1 | 1/2002 | Barrett | |
| 6,581,645 | B1 * | 6/2003 | Johnson et al. | 139/383 A |
| 6,810,917 | B2 * | 11/2004 | Stone | 139/383 A |

* cited by examiner

*Primary Examiner*—John J. Calvert
*Assistant Examiner*—Robert H Muromoto
(74) *Attorney, Agent, or Firm*—McNair Law Firm, P.A.

(57) ABSTRACT

A composite papermaking fabric having an upper support fabric including upper warp and weft yarns and a lower contact fabric including lower warp and weft yarns. The upper fabric is woven in a first weave pattern which forms a support surface and the lower fabric is woven in a broken twill weave pattern which forms the contact surface. The composite fabric includes paired binder yarns which weave in alternating sequences with the upper and lower fabrics binding them together. The broken twill weave pattern provides plural floats of cross-machine direction yarns passing outwardly of a plurality of adjacent lower warp yarns forming a plurality of adjacent cross-machine direction floats. Certain of the paired floats comprise a lower weft yarn and a binder yarn while others may comprise two lower weft yarns. The lower weft yarn floats are positioned to shield and protect the binder yarn floats along their entire length.

21 Claims, 11 Drawing Sheets

COMPOSITE PAPERMAKING FABRIC

BACKGROUND OF THE INVENTION

The instant invention is directed to a composite papermaking fabric formed to provide improved wearability, stability and uniform porosity.

Composite papermaking fabrics are widely used and well known throughout the papermaking industry as is illustrated by U.S. Pat. No. 5,152,326 to Vohringer and U.S. Pat. No. 5,544,678 to Barrett. In composite papermaking fabrics, which comprise upper support and lower contact fabrics, it is a primary object to protect the binding yarns or those which bind the upper and lower fabrics together, from wear. This is necessary because once a binder yarn breaks, the upper and lower fabrics separate destroying the papermaking fabric.

Traditionally, the binder yarns are protected by using smaller yarns and crossing them over the lower fabric yarns adjacent a large knuckle. This approach sometimes interferes with drainage as the binders do not form a part of the basic weave pattern of the upper and lower fabrics.

Another approach is to incorporate the binder yarns into the weave pattern of the upper and lower fabrics. This approach, while improving drainage, subjects them to increased wear. Even when they are incorporated into the weave pattern as smaller yarns, certain areas along their binding length are not protected.

Accordingly, it is an object of the present invention to provide a composite papermaking fabric with improved drainage, stability and wearability.

Another object of the instant invention is a composite papermaking fabric in which the binding yarns form a part of the basic weave pattern of the upper and lower fabrics.

Another object of the invention is the provision that the binder yarns form floats on the contact surface which are protected against wear along their entire length.

Another object of the invention is a composite papermaking fabric in which the binding yarn floats are arranged between protective floats along their entire length.

Another object of the invention is the provision of a composite papermaking fabric which is woven in a 40 pick repeating pattern.

Another object of the invention is the provision of a composite papermaking fabric which is woven in a 70 pick repeating pattern.

SUMMARY OF THE INVENTION

The invention is directed to composite papermaking fabrics having an upper support fabric including upper warp and weft yarns and a lower contact fabric including lower warp and weft yarns with the upper fabric being woven in a first weave pattern forming a support surface and the lower fabric being woven in a broken twill weave pattern forming a contact surface. The composite fabrics include paired binder yarns weaving in alternating sequences with the upper fabric in the first weave pattern and in the lower fabric in the broken twill weave pattern while acting to bind the upper and lower fabrics together.

The contact surface may include a plurality of side by side and at least paired cross-machine direction yarns which form floats passing outwardly of a plurality of adjacent machine direction yarns across the broken twill weave pattern. Certain of the at least paired cross-machine direction yarn floats include at least one of the lower weft yarns and one of the binder yarns. In the paired floats formed by the at least one of the lower weft yarns and one of the binder yarns, the float formed by the one binder yarn is shielded along its entire length by the float formed by the one lower weft yarn. The at least paired cross-machine direction floats may each pass under three adjacent machine direction yarns. The at least paired cross-machine direction floats may comprise a pair of the lower weft yarns and a single binder yarn with the binder yarn being adjacent each of the lower weft yarns.

The lower weft yarns along with the lower warp yarns may be larger in diameter than the binder yarns, the upper weft yarns and the upper warp yarns.

In certain instances, the at least paired cross-machine direction floats may pass under five adjacent machine direction yarns, and in other instances they may pass under three cross-machine direction yarns.

The weave pattern provides that each binder yarn of the pair of binder yarns form at least one float of the paired floats formed across the width of the broken twill weave pattern. Certain ones of the paired cross-machine floats may comprise only adjacent ones of the lower weft yarns.

The upper warp and weft yarns along with the binder yarns are of equal diameter. Also, the upper warp and weft yarns, the lower warp and weft yarns and the binder yarns are formed of one of or a combination of polyester and nylon yarns.

Each of the at least paired cross-machine floats is formed to include at least one of the lower weft yarns.

A composite papermaking fabric which is woven in at least a 40 pick repeating pattern having an upper support fabric including upper warp and weft yarns and a lower contact fabric including lower warp and weft yarns. The weave pattern weaves the upper fabric in a plain weave forming a support surface and the lower fabric in a broken twill weave which forms the contact surface. The composite fabric includes paired binder yarns which weave in alternating sequences with the upper fabric in the plain weave and in the lower fabric in the broken twill weave. The binding yarns act to bind the upper and lower fabrics together.

The contact surface includes a plurality of at least paired cross-machine direction yarns forming floats passing outwardly of a plurality of adjacent of the lower warp yarns across the weave pattern. Certain of the at least paired cross-machine direction yarn floats include at least one of the lower weft yarns and one of the binder yarns. In the cross-machine paired floats formed by the lower weft yarns and the binder yarns, the float formed by the binder yarn is shielded along its entire length by the float formed by the lower weft yarn.

The composite papermaking fabric is woven in one of a 40 pick weave pattern and a 70 pick weave pattern. The cross-machine direction floats comprise two yarns in 40 pick weave pattern and three yarns in the 70 pick weave pattern. The binder yarn float is located adjacent and below a single float formed by the lower weft yarn in the 40 pick weave pattern and between and below two floats formed by the lower weft yarns in the 70 pick weave pattern.

The at least paired cross-machine floats may pass under differing numbers of machine direction yarns within the weave pattern.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

In composite papermaking fabrics a primary concern is wear on the contact surface and more particularly wear of the binding yarns due to contact with the machine rollers. In order to lessen wear of the binder yarns steps are taken to shield them from contact with the machine rollers while maintaining an even support surface, good fabric stability and drainage.

In the instant case, generally a portion of the yarns forming the lower or contact fabric are preferably of a wear resistant synthetic material such as nylon and have a larger diameter than the remainder of the yarns. Preferably the contact fabric yarns are between 0.15–0.30 mm in diameter with about 0.19 mm being the preferred size for the warp yarns and 0.30 mm being the preferred size for the weft yarns.

The support or upper fabric is preferably woven with more stable yarns such as polyester although nylon may also be used. The yarn diameters for the upper or support fabric is between 0.08–0.25 mm with 0.13 mm for the warp and weft being preferred.

The binder yarns are preferably nylon or polyester and are of a diameter within the range of the upper fabric warp and weft yarns with 0.13 mm being the preferred size.

It is noted that other synthetic materials may be utilized as the yarn forming material, the selection being made in accordance to the necessary yarn characteristics and price.

Figure 1:
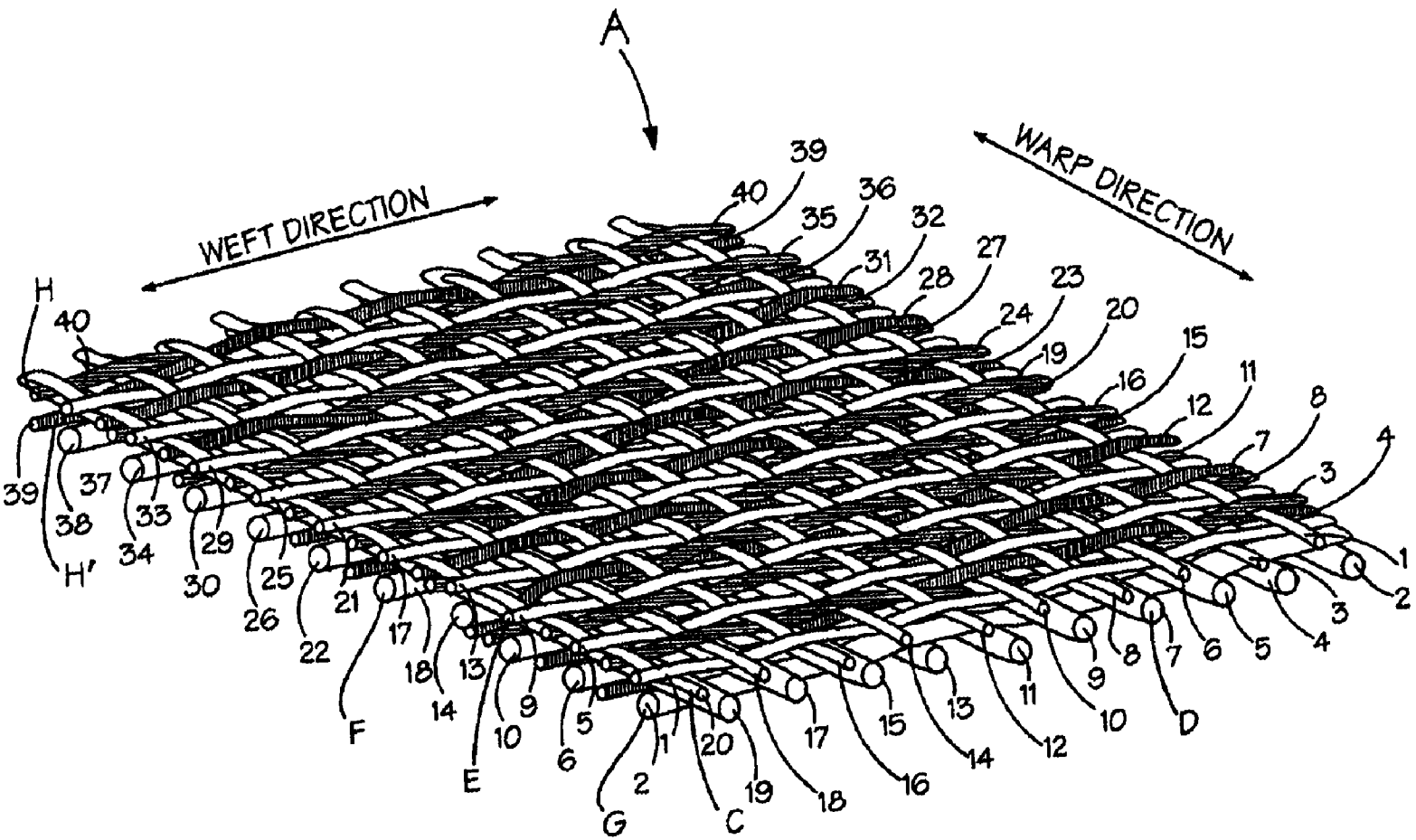
FIG. 1 is a perspective view of a first arrangement of the support surface of the composite papermaking fabric of the invention.
Figure 2:
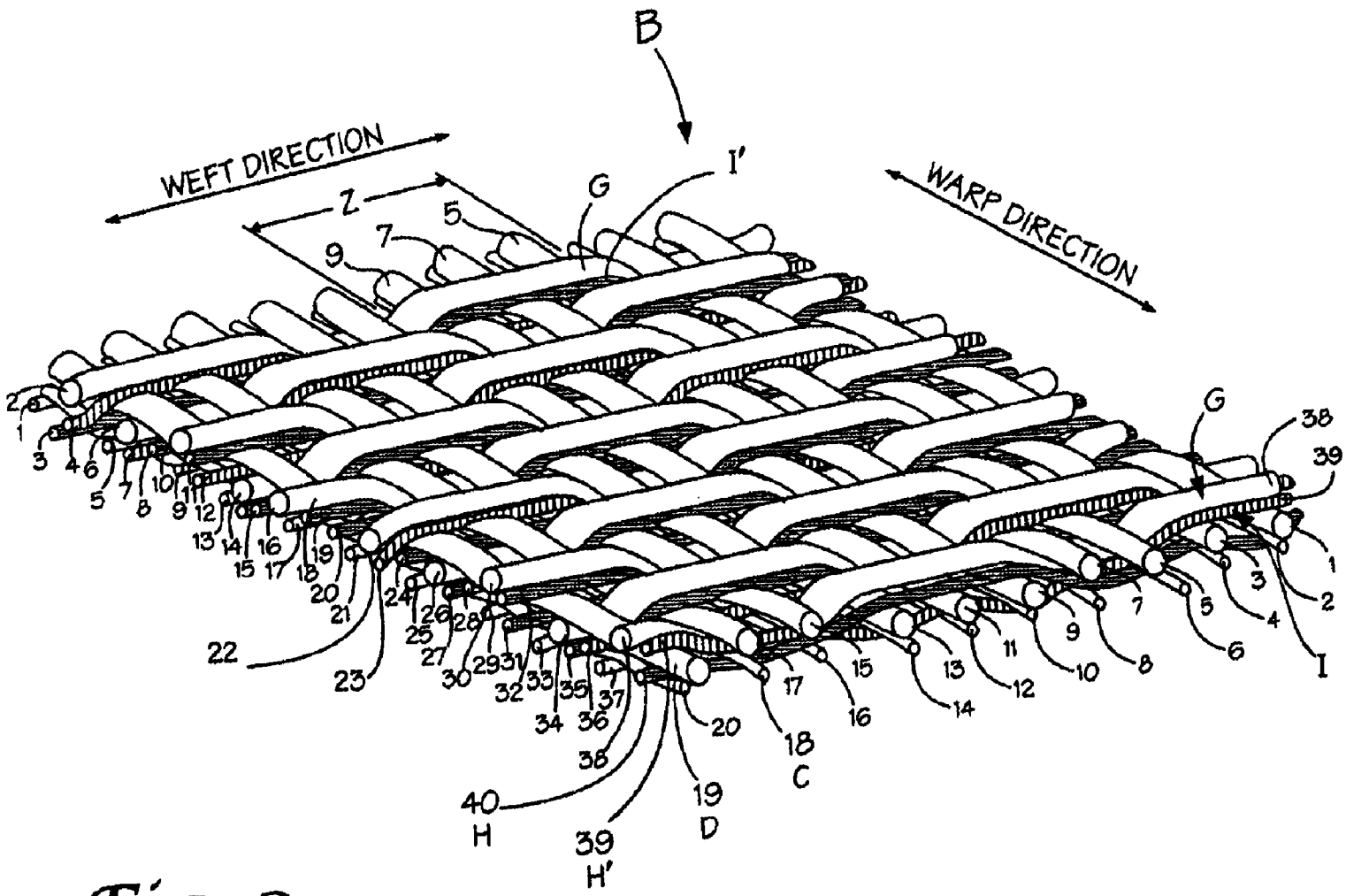
FIG. 2 is a perspective view of the contact surface of the composite fabric shown in FIG. 1.

Turning now to FIGS. 1 and 2, a first arrangement of the composite papermaking fabric of the invention is shown. The top side or the support surface A is shown in FIG. 1 while the bottom side or the contact surface B is shown in FIG. 2. The fabric weave pattern comprises 40 picks of weft yarns and binder yarns interwoven with 20 warp yarns. The picks of weft yarn are numbered in sequence 1–40 and the warp yarns are numbered 1–20. The warp yarns are divided into two groups, the upper warp yarns C and the lower warp yarns D. The weft yarns are also divided into two groups, the upper weft yarns E and the lower weft yarns F. The binder yarns, identified as H & H', comprise alternating pairs of picks 3, 4, 7, 8, 11, 12, 15, 16, 19, 20, 23, 24, 27, 28, 31, 32, 35, 36, 39, 40. The binder yarns weave in the weft direction in both the upper and lower fabrics.

The upper warp yarns C along with the upper weft yarns E weave only with the upper or support fabric A and lower warp and weft yarns D and G weave only with the lower or contact fabric B. The binder yarns H, H' weave with both the upper and lower warp yarns in opposing sequences.

Turning now to FIG. 1, it can be seen that support fabric A is woven in a plain weave with pick 1 of upper weft yarn E weaving only with upper warp yarns C across the weave pattern. Pick 2 weaves to form contact fabric B and weaves across the weave pattern with lower warp yarns D in a sequence to be discussed later. Pick 3 and 4 comprise binder yarns H, H' which in alternating manner weave with the upper warp yarns in a plain weave across the weave pattern. The binder yarns also weave in a manner to be discussed with the lower warp yarns in an alternating manner.

As shown, upper weft yarns weave on opposite sides of each row formed by the binder yarns. It is noted that the composite fabric weave concept of this invention includes having more than one upper weft yarn on opposite sides of each binder row.

Turning now to FIG. 2, contact fabric B is shown woven in a broken twill weave pattern. The lower weft yarns are shown first weaving outwardly of three adjacent lower warp yarns D and then inwardly of two adjacent lower warp yarns forming floats G over the contact surface.

Binder yarns H, H' weave in a similar manner passing outwardly of and beneath the same warp yarns as the adjacent lower weft yarns forming floats I, I' across the weave pattern. It is noted that while binder yarn H is forming float I, binder yarn H' is weaving in a plain weave with support fabric A and when binder yarn H' weaves to form floats I', binder yarn H is weaving with the support fabric. The floats G, I & I' each pass outwardly of three adjacent lower warp yarns so that a float G formed by lower weft F appears adjacent the entire length of each float I or I' formed by binder yarns H, H' as is clearly shown at Z in FIG. 2. Because the lower weft yarns have approximately twice the diameter of the binder yarns, binder floats I, I' have no exposed ends and are protected along their entire length.

Figure 7:
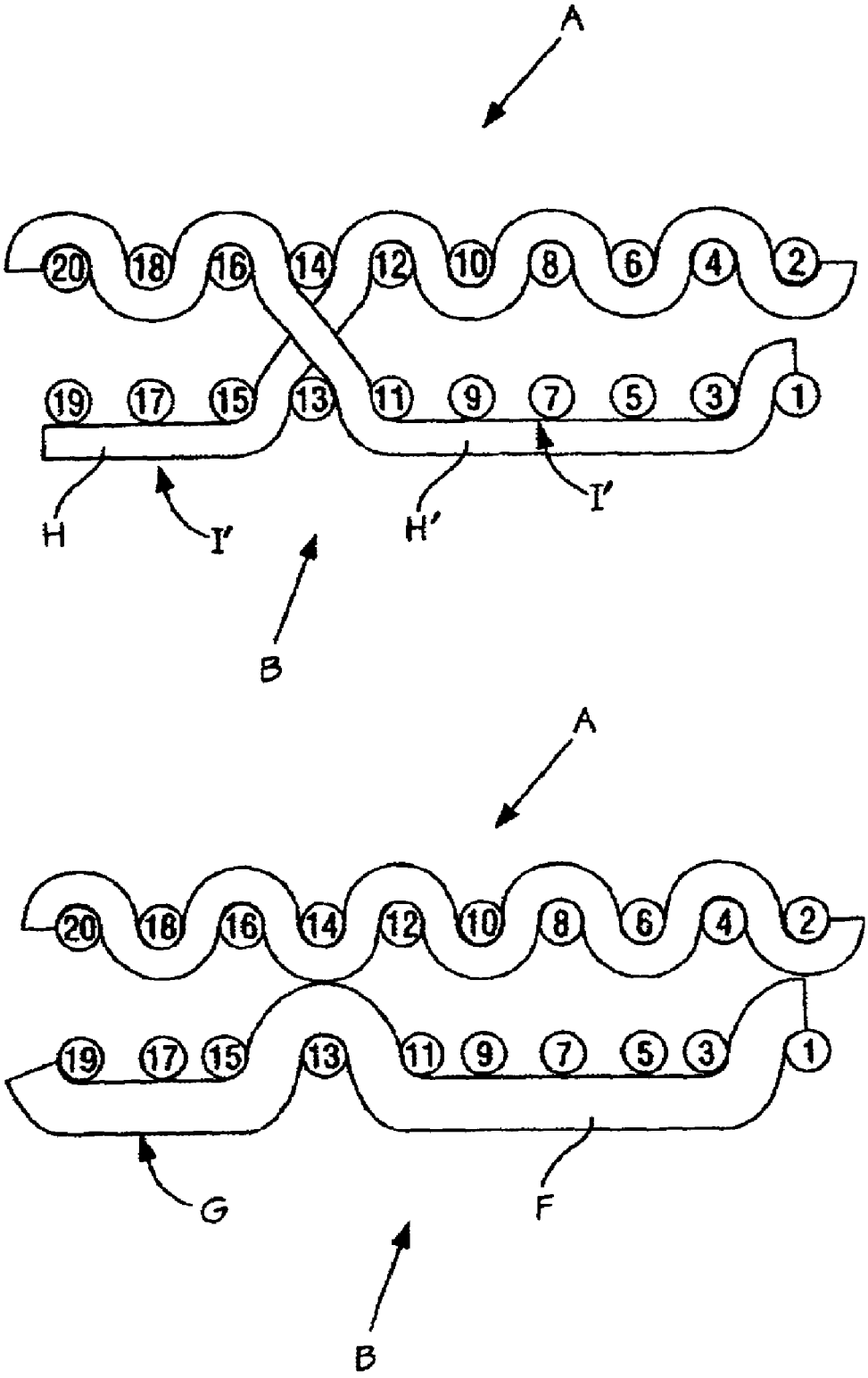
FIG. 7 is a detailed side view of an alternative arrangement for forming the float and plain weave sections of the fabrics shown in FIGS. 1, 2, 4 and 5.

Turning now to FIG. 7, an alternative arrangement for the weave pattern is shown. In the alternative arrangement there are also two floats formed across the weave pattern with floats G formed by the lower weft yarns E and floats I, I', formed by binder yarns H, H'. The floats formed alternate between a weft and binder yarn passing outwardly of three and then five warp yarns across the weave pattern. The floats are separated by a single warp yarn. Again the paired adjacent floats are of the same length so that the binder yarns floats are covered along their entire length, as clearly illustrated at Z in FIG. 2.

Figure 3:
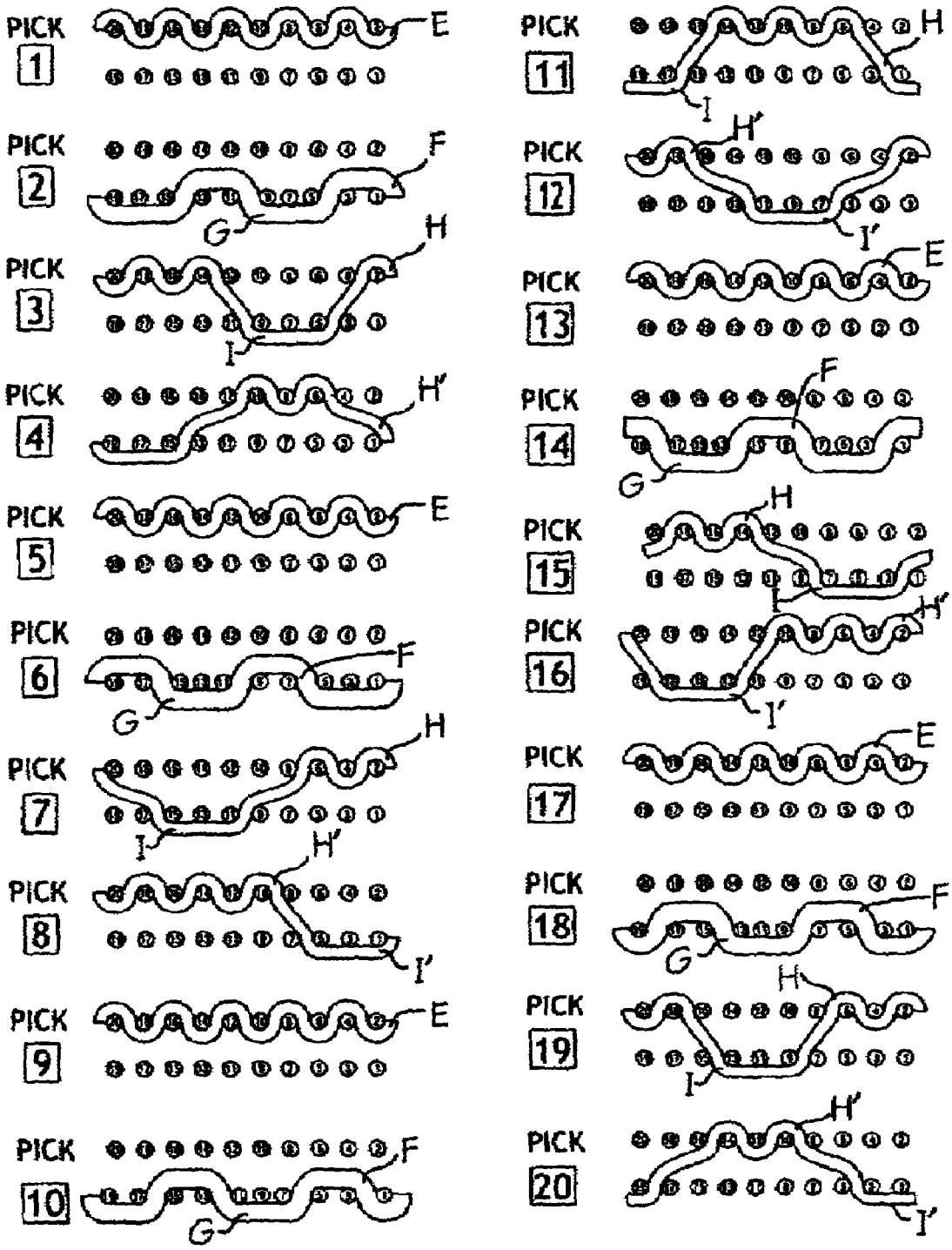
FIG. 3 is a detailed side view of the inter-relationship of each weft and binder yarns with the warp yarns on each of the 40 picks of the weave pattern forming the fabric shown in FIGS. 1 and 2.
Figure 3:
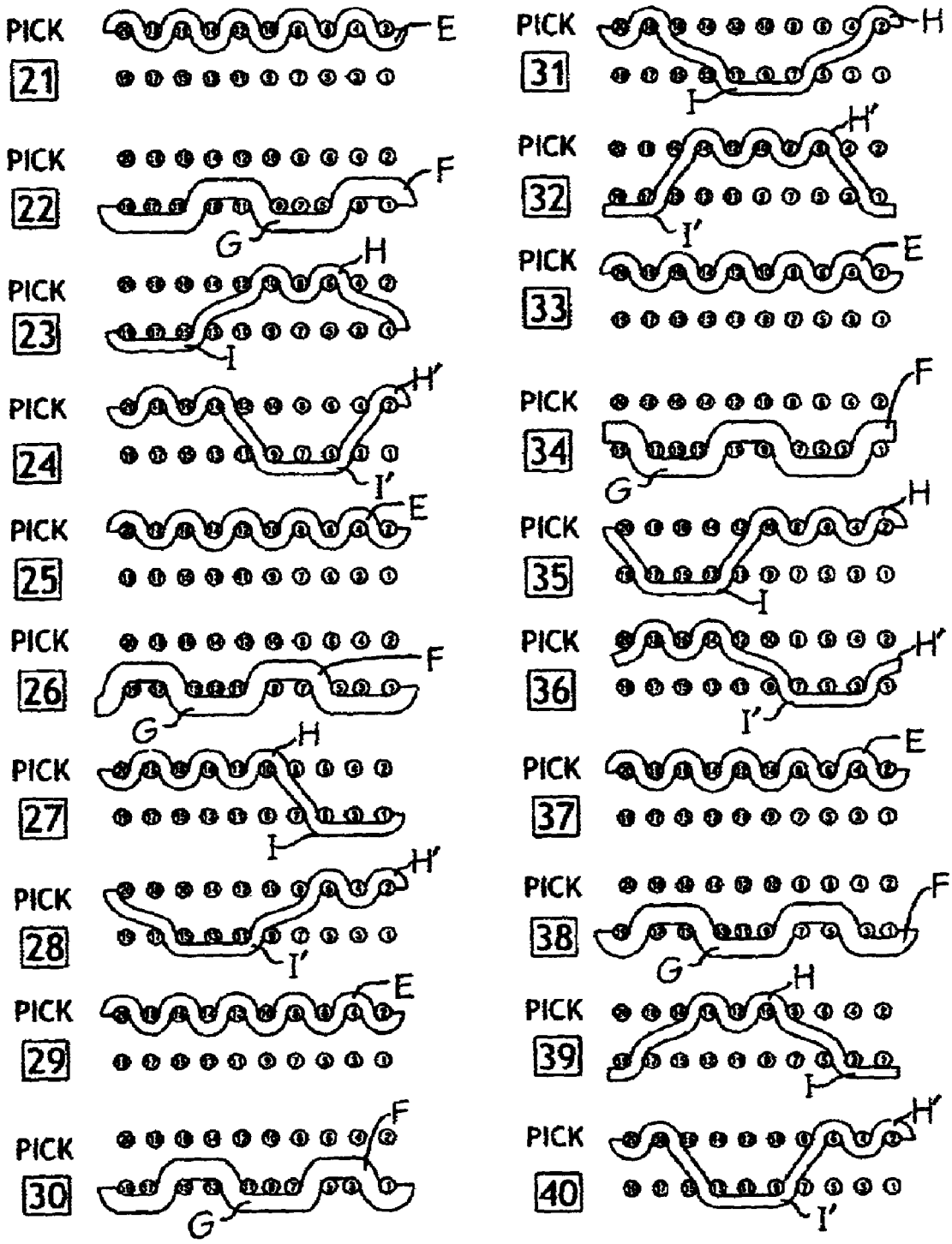

Turning now to FIG. 3, the relationship of each weft yarn and each binder yarn relative to each warp yarn throughout the weave pattern is shown.

Beginning with pick 1 which is an upper weft yarn weaving only with upper warp yarns 2, 4, 6, 8, 10, 12, 14, 16, 18 and 20 through pick 40 which is a binder yarn weaving with both the upper and lower warp yarns 1–20, the inter-relationship of each weft or binder yarn relative to the warp yarns is shown.

Pick 2 is shown passing beneath warp yarns 15, 17, 19 forming a first float G and also beneath warp yarns 5, 7, 9 forming a second float G as it passes across the weave pattern. In the adjacent row formed by binder yarns H, H', pick 3 weaves first with upper warp yarns 14, 16, 18 and 20 before passing beneath lower warp yarns 5, 7, 9 forming float 1. Pick 4 first passes beneath warp yarns 15, 17, 19 before then weaving with upper warp yarns 4, 6, 8, 10. The binder yarns cross between warp yarns 3, 4 and 11, 12.

The sequence is repeated throughout the weave pattern utilizing different ones of upper and lower warp yarns weaving with the weft and binder yarns forming ten rows of paired floats along the weave pattern, each row comprising two sets of paired floats across the weave pattern.

Figure 4:
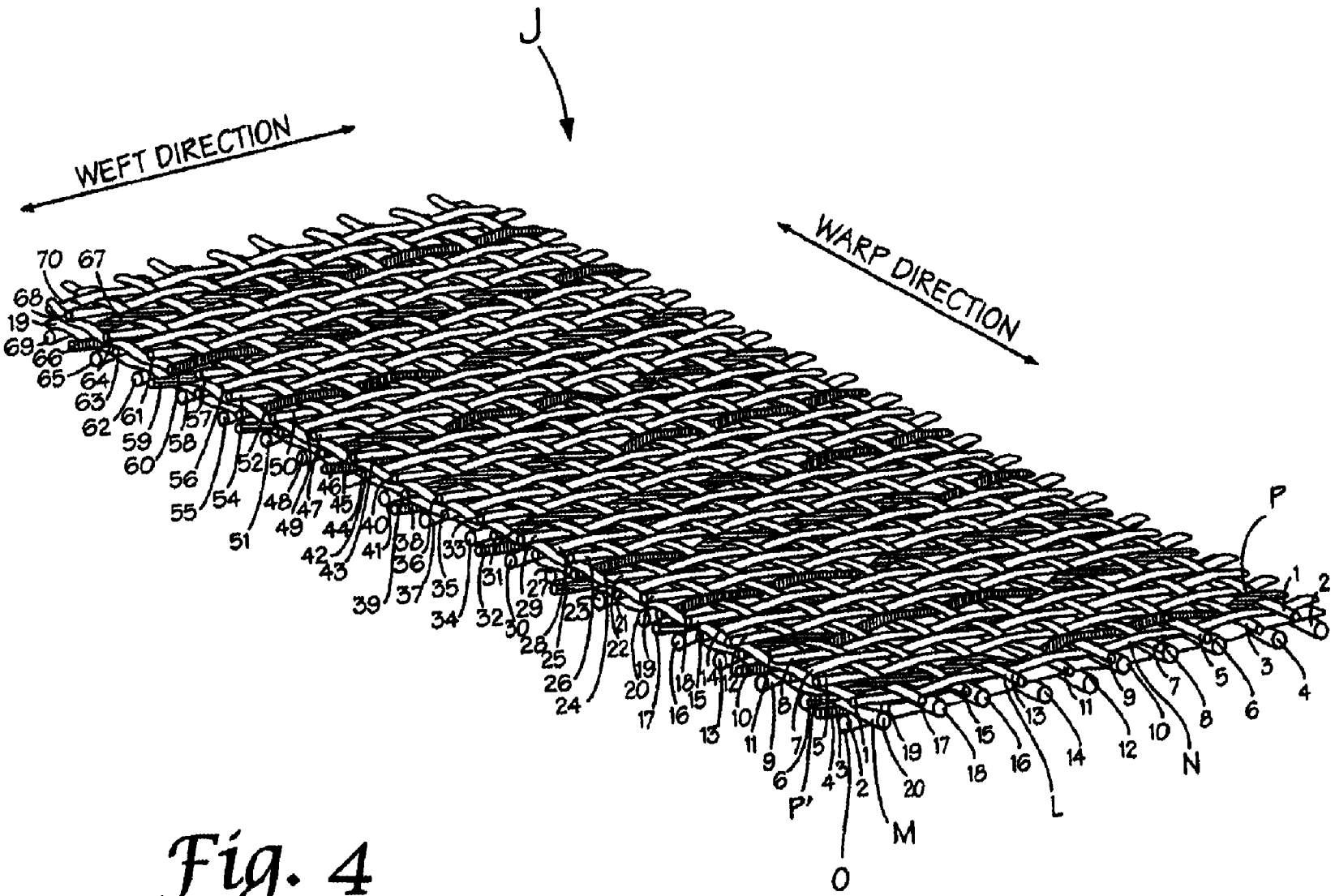
FIG. 4 is a perspective view of a second arrangement of the support surface of the composite papermaking fabric of the invention
Figure 5:
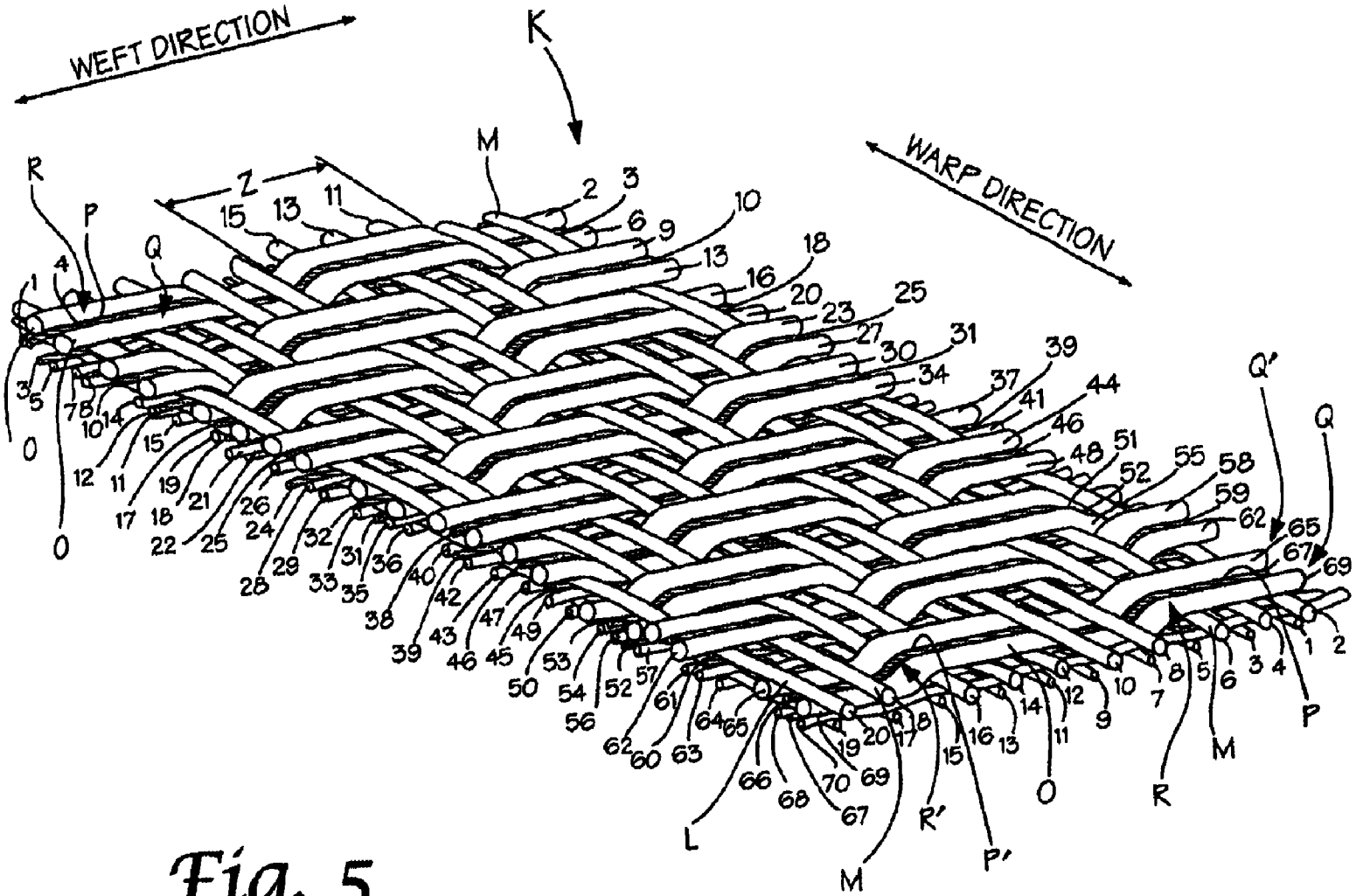
FIG. 5 is a perspective view of the contact surface of the papermaking fabric shown in FIG. 4.

Turning now to FIGS. 4 and 5 which show top and bottom perspective views of another arrangement of a composite papermaking fabric. Again, the composite papermaking fabric comprises upper or support fabric J having a support surface woven in a plain weave and lower or contact fabric K woven in a broken twill weave. The weave pattern is a 70 pick 20 warp weave with each warp yarn of the weave pattern numbered 1–20 and each pick of weft yarn numbered 1–70.

Generally the fabric of FIGS. 4 and 5 is similar to the fabric shown in FIGS. 1 and 2 in that a primary object is to provide increased protection or shielding against wear for the binder yarns while maintaining an even support surface, good fabric stability and drainage. In the instant arrangement an additional binder coverfloat is provided, that is each binder float on the contact surface is formed between a pair of lower weft yarn floats which extend along the entire length of the binder float.

Turning to FIG. 4, it can be seen that upper fabric J is woven in a plain weave with upper weft yarns N along with binder yarns P, P' weaving with upper warp yarns L in a plain weave. Binder yarns P, P' weave in opposing sequences with the upper fabric and the lower fabric as in the arrangement shown in FIGS. 1 and 2. Also, the yarn composition and sizes are as earlier described.

Lower fabric K, as shown in FIG. 5 comprises a broken twill weave which presents a series of weft direction multi-yam floats, Q, Q', R & R' along and across the weave pattern. Each float comprises a first lower weft yarn O passing outwardly of first three adjacent lower warp yarns M, inwardly of two adjacent lower warp yarns and then outwardly of three additional lower warp yarns forming two floats Q across the weave pattern. Adjacent each of these floats is a binder yarn float R or R' formed by one of binder yarns P, P' which passes outwardly of the same first three lower warp yarns. This binder yarn then passes to the upper or support fabric J to weave in a plain weave across the remainder of the weave pattern. The other of the binder yarns P or P' which has been weaving with support fabric J now pass to weave the contact fabric and is passed outwardly of the same additional lower warp yarns as lower weft yarn O forming a binder yarn float R or R'. The next lower weft yarn O' now passes outwardly of the referred to first three adjacent lower warp yarns, inwardly of the next two lower warp yarns and finally outwardly of the three additional lower warp yarns forming a second pair of lower weft floats Q' across the width of the weave pattern. The multi-yarn floats comprising a first lower weft yarn O, binder yarns P and P' and a second lower weft yarn O' are arranged in side by side positions with the binder yarn float positioned between the lower weft yarn floats. All floats are the same length and pass over the same adjacent warp yarns as shown at Z in FIG. 5. This arrangement provides maximum protection against contact with support rollers for the binder yarn floats.

Turning again to FIG. 7, it is noted that the interlacing sequences of the lower warp yarns with the lower weft and binder yarns may be altered to provide first and second floats of differing lengths across the weave pattern and over the contact surface. It is noted that in this arrangement the weave would still provide that each lower binder yarn float be sandwiched between a pair of lower weft yarn floats.

Figure 6:
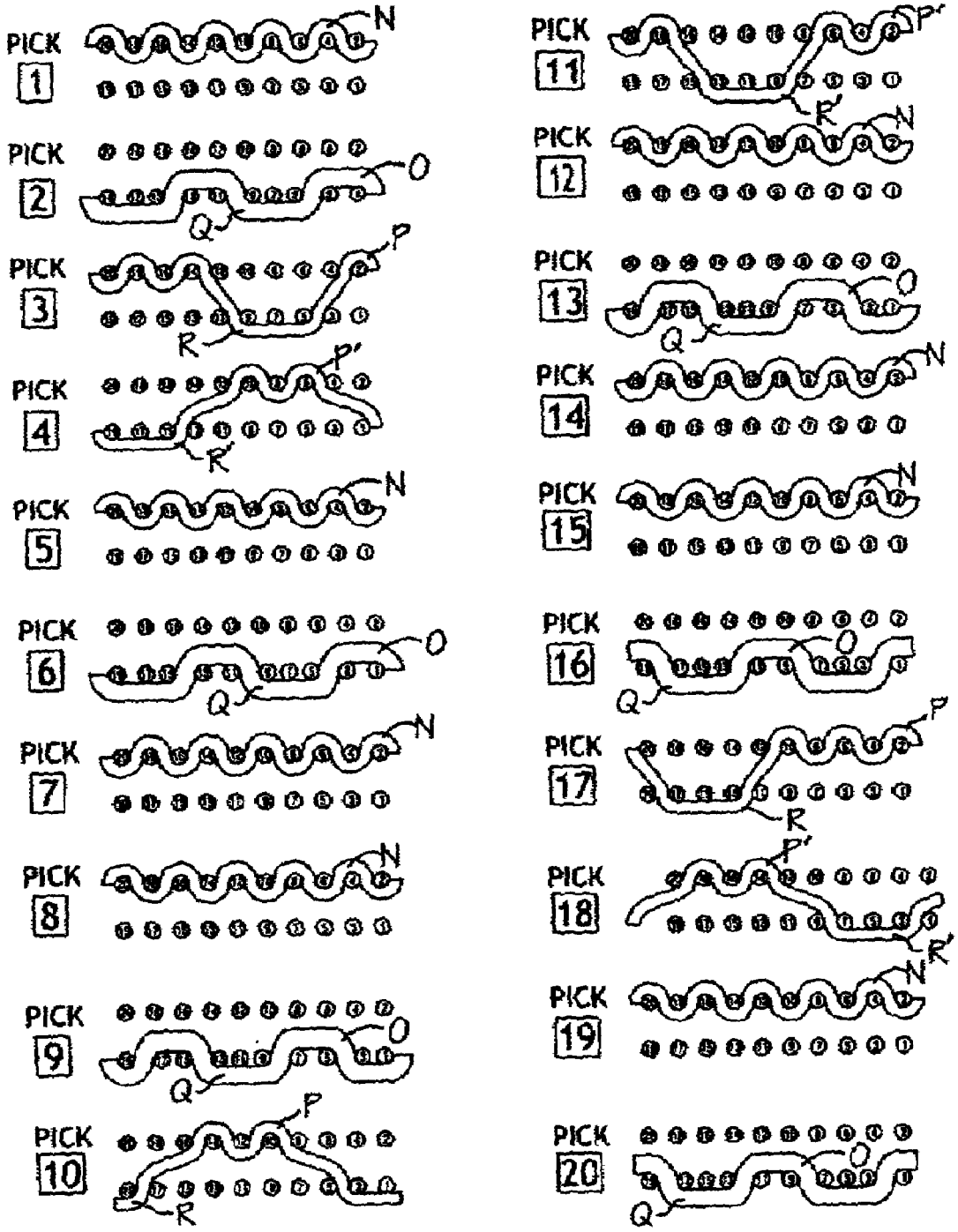
FIG. 6 is a detailed side view of the inter-relationship of each weft and binder yarn with the warp yarns on each of the 70 picks of the weave pattern forming the fabric shown in FIGS. 4 & 5.
Figure 6:
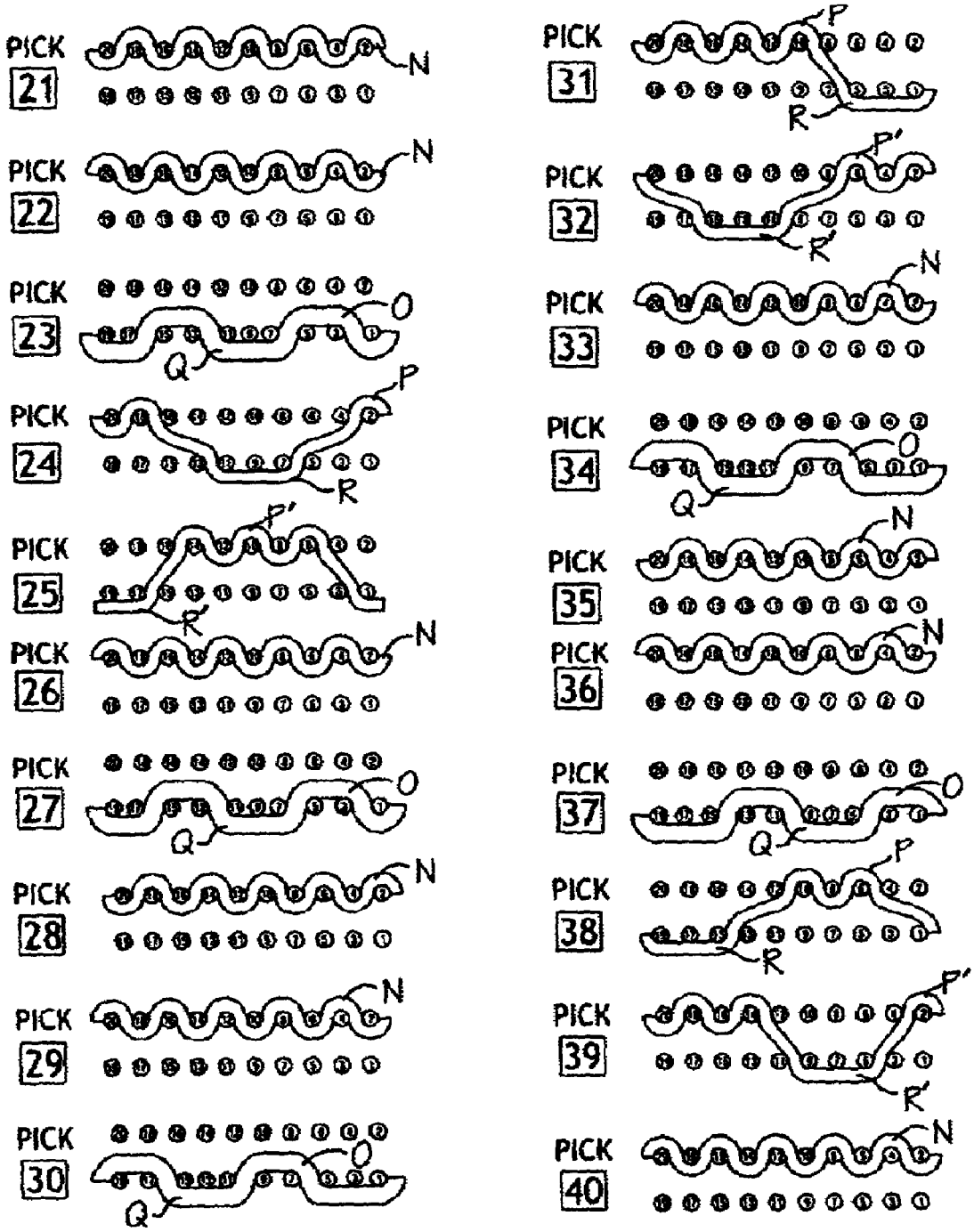
Figure 6:
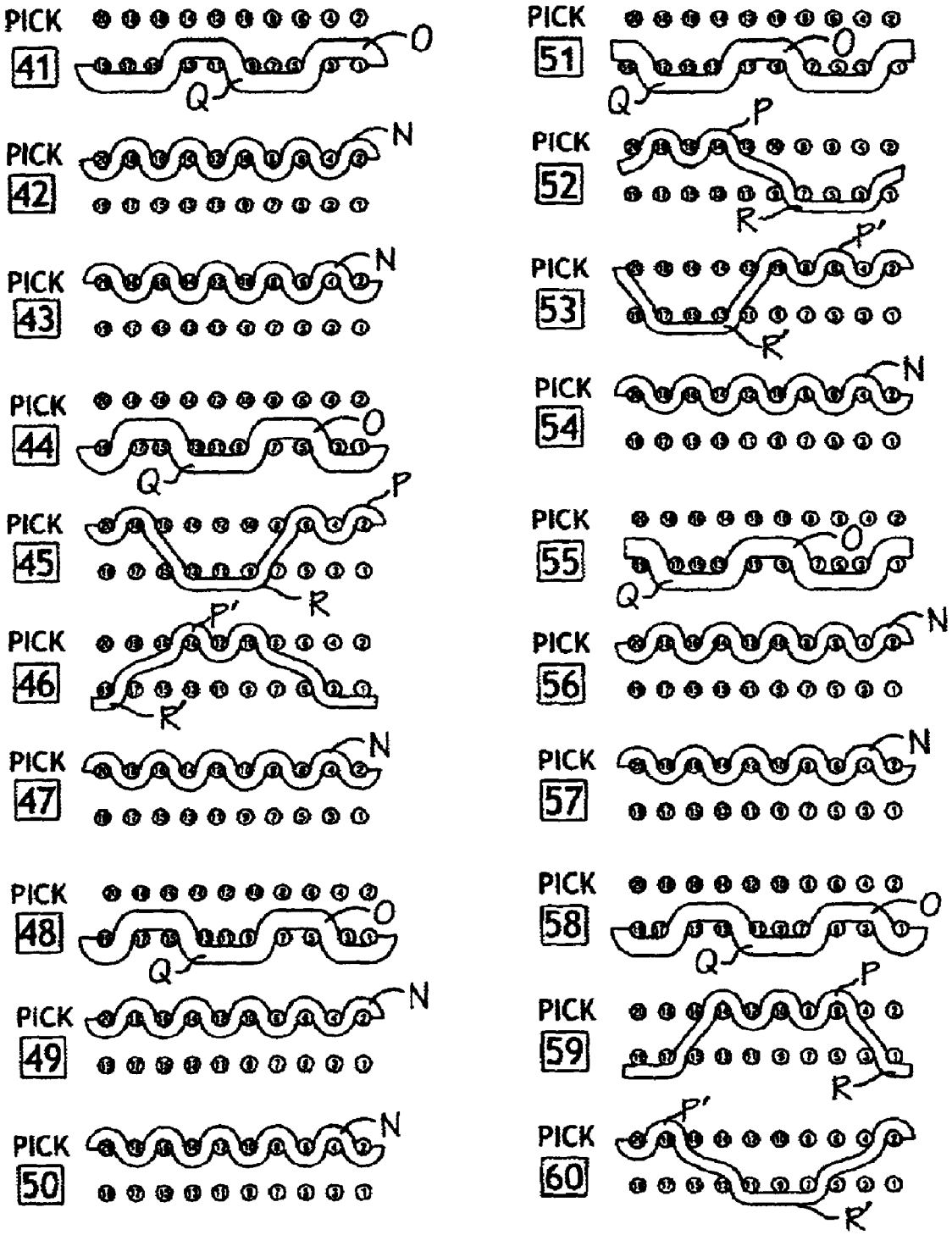
Figure 6:
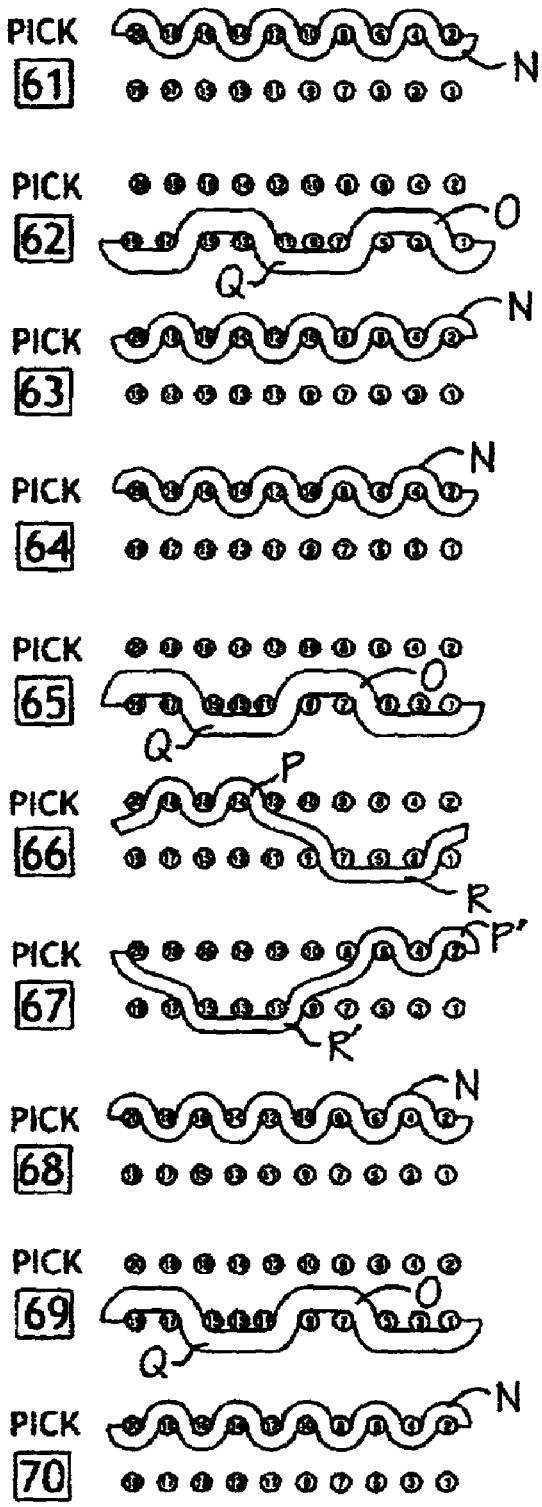

Turning now to FIG. 6, each pick of the 70 pick weave pattern is shown in sequence as it interweaves with the 20 warp yarns of the weave pattern. Pick 1 is a support fabric pick and is shown weaving in a plain weave with the upper warp yarns which are even numbered 2–20. Pick 2 is a lower weft yarn pick and is shown weaving with the lower warp yarns numbered 1–19. Pick 2 forms a pair of contact surface floats Q passing outwardly of warp yarns 5, 7, 9 and 15, 17, 19. Pick 3 is binder yarn P shown weaving with half of the upper warp yarns 12, 14, 16, 18 and 20 in a plain weave and weaving with lower warp yarns forming a float beneath lower warp yarns 5, 7, 9. Pick 4 is a binder yarn P' which weaves opposite pick 3 forming float R' beneath warp yarns 15, 17, 19 and weaving with the remainder of the upper warp yarns. Pick 5 is a second upper weft yarn. Pick 6 is a second lower weft yarn forming a pair of floats Q' beneath warp yarns 5, 7, 9 and 15, 17, 19. The floats Q & Q' formed by picks 2 and 6 are formed on opposing sides of binder yarn floats R and R' to extend along the entire length of the binder yarn float, as shown at Z in FIG. 5, sandwiching and protecting the binder yarn floats from contact with the contact rollers.

Picks 3–70 continue the progression of multi-yarn floats over the weave pattern.

While a preferred embodiment of the invention has been described using specific terms, such description is for illustrative purposes only, and it is to be understood that changes and variations may be made without departing from the spirit or scope of the following claims.

What is claimed is:

1. A composite papermaking fabric having an upper support fabric including upper warp and weft yarns and a lower contact fabric including lower warp and weft yarns, said upper fabric being woven in a first weave pattern forming a support surface and said lower fabric being woven in a broken twill weave pattern forming a contact surface, said composite fabric including paired binder yarns weaving in alternating sequences with said upper fabric in said first weave pattern and in said lower fabric in said broken twill weave pattern binding said upper and lower fabrics together:

said contact surface including a plurality of at least paired cross-machine direction yarns forming a plurality of floats passing outwardly of a plurality of adjacent machine direction yarns across the broken twill weave pattern, certain of said at least paired cross-machine direction yarn floats include at least one of said lower weft yarns and one of said binder yarns whereby;

in said paired floats formed by said at least one of said lower weft yarns and one of said binder yarns, said float formed by said one binder yarn is shielded along its entire length by said float formed by said one lower weft yarn.

2. The composite papermaking fabric of claim 1 wherein said paired cross-machine direction floats pass under three adjacent machine direction yarns.

3. The composite papermaking fabric of claim 1 wherein said certain of said paired floats formed across said broken twill weave pattern includes at least one float formed by each of said paired binder yarns.

4. The composite papermaking fabric of claim 1 wherein said lower weft yarns are larger in diameter than said binder yarns.

5. The composite papermaking fabric of claim 1 wherein said at least one lower weft yarn comprises two lower weft yarns arranged on opposing sides of said binder yarn floats.

6. The composite papermaking fabric of claim 1 wherein certain of said at least paired cross-machine direction floats pass under five adjacent machine direction yarns.

7. The composite papermaking fabric of claim 1 wherein said broken twill weave pattern provides that each said binder yarn of said pair of binder yarns form at least one float of said plurality of paired floats across the width of said broken twill weave pattern.

8. The composite papermaking fabric of claim 1 wherein certain ones of said paired cross-machine floats comprise adjacent ones of said lower weft yarns.

9. The composite papermaking fabric of claim 1 wherein said lower warp and weft yarns are of a larger diameter than said upper warp and weft yarns.

10. The composite papermaking fabric of claim 9 wherein said binder yarns and said upper warp and weft yarns are of equal diameter.

11. The composite papermaking fabric of claim 1 wherein said upper warp and weft yarns, said lower warp and weft yarns and said binder yarns are formed of one of polyester and nylon yarns.

12. The composite papermaking fabric of claim 1 wherein each said lower fabric weft yarn forms at least a portion of said plurality of paired cross-machine direction floats per repeat of said broken twill weave pattern.

13. The composite papermaking fabric of claim 1 wherein said cross-machine yarns forming successive of said plurality of paired floats pass outwardly of different numbers of said machine direction yarns forming said plurality of paired floats of different lengths across said broken twill weave pattern.

14. The composite papermaking fabric of claim 1 wherein each binder yarn of said binder yarn pair weave with equal numbers of said upper and lower warp yarns across said weave pattern.

15. A composite papermaking fabric woven in a 40 pick repeating weave pattern having an upper support fabric including upper warp and weft yarns and a lower contact fabric including lower warp and weft yarns, said weave pattern weaves said upper fabric in a plain weave forming a support surface and said lower fabric in a broken twill weave forming a contact surface, said composite fabric including paired binder yarns weaving in alternating sequences with said upper fabric in said plain weave and in said lower fabric in said broken twill weave binding said upper and lower fabrics together:

said contact fabric including a plurality of paired cross-machine direction yarns forming floats passing outwardly of a plurality of adjacent of said lower warp yarns across the weave pattern, certain of said plurality of paired cross-machine direction yarn floats include first ones of said binder yarn pairs and at least one of said lower weft yarns and other ones of said plurality of paired cross-machine direction yarn floats include a second of said binder yarns and at least one of said lower weft yarns; whereby, in said paired floats formed by said lower weft yarns and said binder yarns, said binder yarn floats are shielded along its entire length by said floats formed by said lower weft yarns.

16. A composite papermaking fabric woven in a 70 pick repeating weave pattern having an upper support fabric including upper warp and weft yarns and a lower contact fabric including lower warp and weft yarns, said weave pattern weaves said upper fabric in a plain weave forming a support surface and said lower fabric in a broken twill weave forming a contact surface, said composite fabric including paired binder yarns weaving in alternating sequences with said upper fabric in said plain weave and in said lower fabric in said broken twill weave binding said upper and lower fabrics together:

said contact surface including a plurality of multi-yarn cross-machine direction floats formed by three adjacent cross-machine direction yarns passing outwardly of a plurality of adjacent machine direction yarns across the broken twill weave pattern, the intermediate of said three cross-machine direction yarn floats comprises one of said pair of binder yarns and the other of said three adjacent cross-machine direction yarns comprises said lower weft yarns, whereby;

said binder yarn floats are shielded along their entire length between said lower weft yarn floats.

17. The composite papermaking fabric of claim 16 wherein said cross-machine direction floats are of different lengths across the weave pattern.

18. The composite papermaking fabric of claim 16 wherein said cross-machine direction floats are of equal lengths across said weave pattern.

19. A composite papermaking fabric woven in a 70 pick repeating weave pattern having an upper support fabric including upper warp and weft yarns and a lower contact fabric including lower warp and weft yarns, said weave pattern weaves said upper fabric in plain weave forming a support surface and said weave pattern weaves said lower fabric in a broken twill weave forming a contact surface, said composite fabric includes paired binder yarns weaving in alternating sequences with said upper fabric in said plain weave and in said lower fabric in said broken twill weave binding said upper and lower fabrics together:

said contact surface includes a plurality of multi-yarn cross-machine direction floats formed by three adjacent cross-machine direction yarns passing outwardly of a plurality of adjacent machine direction yarns across the broken twill weave pattern, the intermediate of said three cross-machine direction yarn floats comprises one of said pair of binder yarns and the outer of said three cross-machine direction yarn floats comprises said lower weft yarns; whereby, said binder yarn floats are shielded on each side along their entire length between said lower weft yarn floats.

20. The composite papermaking fabric of claim 19 wherein said cross-machine direction floats are of different lengths across the weave pattern.

21. The composite papermaking fabric of claim 19 wherein said cross-machine direction floats are of equal length across said weave pattern.

* * * * *